US012246238B2

(12) United States Patent
Lee

(10) Patent No.: US 12,246,238 B2
(45) Date of Patent: Mar. 11, 2025

(54) PUTTING PRACTICE DEVICE FOR TRAINING OF KEEPING PUTTER FACE SQUARE AND CONTROLLING PUTTING STRENGTH

(71) Applicants: CGS T&F CO., LTD., Cheongju-si (KR); Han So Lee, Cheongju-si (KR)

(72) Inventor: Han So Lee, Cheongju-si (KR)

(73) Assignees: CGS T&F CO., LTD., Cheongju-si (KR); Han So Lee, Cheongju-si (KR)

( * ) Notice: Subject to any disclaimer, the term of this patent is extended or adjusted under 35 U.S.C. 154(b) by 206 days.

(21) Appl. No.: 17/921,611

(22) PCT Filed: Oct. 21, 2021

(86) PCT No.: PCT/KR2021/014819
§ 371 (c)(1),
(2) Date: Oct. 26, 2022

(87) PCT Pub. No.: WO2022/086224
PCT Pub. Date: Apr. 28, 2022

(65) Prior Publication Data

US 2023/0158389 A1 May 25, 2023

(30) Foreign Application Priority Data

Oct. 22, 2020 (KR) ..... 10-2020-0137562

(51) Int. Cl.
*A63B 69/36* (2006.01)

(52) U.S. Cl.
CPC ..... *A63B 69/3676* (2013.01); *A63B 69/362* (2020.08); *A63B 2220/20* (2013.01); *A63B 2220/53* (2013.01); *A63B 2225/09* (2013.01)

(58) Field of Classification Search
CPC ..... A63B 69/3676; A63B 69/362; A63B 2220/20; A63B 2220/53; A63B 2225/09;
(Continued)

(56) References Cited

U.S. PATENT DOCUMENTS 3,471,155 A * 10/1969 Donaldson ..... A63B 69/36211 473/260
3,894,739 A * 7/1975 Goldstein ..... A63B 69/3676 473/265

(Continued)

FOREIGN PATENT DOCUMENTS

KR 2019950026922 U 10/1995
KR 1020040084588 A 10/2004

(Continued)

*Primary Examiner* — Nini F Legesse
(74) *Attorney, Agent, or Firm* — You & IP, LLC

(57) ABSTRACT

Disclosed is a putting practice device configured to enable training of keeping a putter face square without checking movement of a golf ball, to enable training of controlling putting strength as well as keeping the putter face square, and to enable training of practicing linear motion of a putter during execution of a putting stroke while an actual golf ball is struck. The putting practice device for the training of keeping the putter face square and controlling the putting strength includes an advance groove, a base plate, a striking part, an impact sensor, and a display part.

7 Claims, 7 Drawing Sheets

(58) Field of Classification Search
CPC ..... A63B 69/3617; A63B 2071/0694; A63B 2220/833; A63B 67/02
USPC ..... 473/219–225, 198–200, 140, 141, 151, 473/407, 257, 278, 279
See application file for complete search history.

(56) References Cited

U.S. PATENT DOCUMENTS 5,443,265 A * 8/1995 Wheeler ..... A63B 69/3676 473/257
6,669,574 B1 * 12/2003 Riley ..... A63B 69/3676 473/279
6,702,690 B1 * 3/2004 Albright ..... A63B 69/3676 473/219
6,786,833 B2 * 9/2004 Ahrend ..... A63B 71/06 473/265
6,840,870 B1 * 1/2005 Froggatte ..... A63B 24/0003 473/265
6,997,817 B1 * 2/2006 Consiglio ..... A63B 69/3676 473/219
7,001,285 B1 * 2/2006 Ahrend ..... A63B 47/002 473/265
7,815,516 B1 * 10/2010 Mortimer ..... A63B 24/0021 473/257
2007/0032307 A1 2/2007 Coombs
2014/0155187 A1 * 6/2014 Spelman ..... A63B 69/3685 473/220

FOREIGN PATENT DOCUMENTS

KR 200377371 Y1 3/2005
KR 200407742 Y1 2/2006
KR 1020090003564 A 1/2009
KR 101168347 B1 7/2012
KR 1020180061669 A 6/2018

* cited by examiner (a)

(b)

(a)

(b)

PUTTING PRACTICE DEVICE FOR TRAINING OF KEEPING PUTTER FACE SQUARE AND CONTROLLING PUTTING STRENGTH

TECHNICAL FIELD

The present invention relates to a putting practice device for training of keeping a putter face square and controlling putting strength, and more particularly to a putting practice device configured to enable training of keeping a putter face square without checking movement of a golf ball, controlling putting strength as well as keeping the putter face square, and practicing linear motion of a putter during execution of a putting stroke while an actual golf ball is struck.

BACKGROUND ART

A golf putter has a relatively high frequency of use compared to other clubs among fourteen golf clubs formed and regulated by the Royal & Ancient Golf Club of St. Andrews (R&A) and the United States Golf Association (USGA). Accordingly, the swing of a putter is more important than the swing of other golf clubs.

Putting is the act of striking a golf ball with a putter, and golf playing is successfully completed when a golf ball having a diameter of 41.14 mm to 42.67 mm is rolled into a hole having a diameter of 108 mm, that is, when a golf ball falls into a hole cup. Putting has a very short swing among various types of swings. Here, a putting distance of two feet is as important as a driving distance of three hundred yards, so a golf ball flight distance and power are not relatively important in putting. That is, in the case in which a golfer strikes a golf ball and the golf ball lands in a place closest to a putting green, if the golfer makes a mistake in putting, there is no chance to recover from the mistake. Accordingly, it is important to enhance golfer's putting skills to obtain a better score.

In the related art, as a method of enhancing putting skills using a putting practice device, for example, disclosed are a method in which a target device configured to allow a golf ball to go thereinto is provided on an artificial lawn mat and a golfer directly strikes a golf ball to putt the same into the target device, and a method in which a golfer uses a putter device, provided with a special device and designed only for simple practice, instead of using his or her own putter used in the golf field in order to correct a putting posture or the like.

In the former method, a golfer strikes a golf ball only toward the target device. For this reason, even if a golfer strikes a golf ball in the wrong direction to the left or right, it is difficult to easily determine whether the problem is simply a matter of a putting posture, a matter of balance of a putting stroke, or a matter of a physical feeling state. Furthermore, even if a golf ball moves forwards in the intended direction, it is also difficult to determine how the golf ball moves forwards in the intended direction. Accordingly, it is difficult to acquire a consistent sense of balance for a putting stroke.

Meanwhile, in the latter method, there may be some effects in correcting a putting posture. However, there are many shortcomings to mastering a basic sense of balance for an actual putting stroke, and a golfer may not use his or her own putter used in the game during putting practice. Additionally, there is a disadvantage in that it is impossible to directly check the degree of putting stroke balance when one putting stroke is executed.

In order to solve the above-described problems, a "device for golf putting stroke practice" is disclosed in Korea Utility Model Registration No. 20-0407742 (registered on Jan. 26, 2006). The utility model relates to a device for golf putting stroke practice configured to enable a golfer to obtain a sense of balance for a putting stroke by striking a golf ball with a front end of a putter striking surface and a rear end thereof in a balanced manner so that the golf ball struck by the putter striking surface may consistently move in a straight line with the amount of force applied to the golf ball in the intended direction when putting stroke action (also referred to as putting), which is said to be the most important for performance in golf, is executed. Here, two putter striking parts are disposed side by side on the device so that the same may be simultaneously struck by one putting stroke action. Thereafter, the kinetic energy caused by the one putting stroke action is simultaneously transmitted to each of the two golf balls through a striking rod guide and a striking rod provided in the device and a golf ball striking surface of a putter, and each of the two struck golf balls performs movement thereof along a rail formed on the device. In this manner, a golfer may directly check a difference between traveling distances of the two struck golf balls, thereby making it possible not only to detect a difference in balance of striking force between the front end of the putter striking surface and the rear end thereof during the putting stroke action, but also to correct a putting posture by clearly confirming problems related to the difference in balance of striking force. Particularly, the device is characterized in that the end of the rail is curved upwards so that the two golf balls simultaneously struck by the putter are naturally dropped by gravity and return to original positions thereof before execution of a putting stroke.

However, in consideration of the above-described device, it is required to consistently watch the traveling directions of the two balls in order to grasp the balance of striking force applied to the two golf balls by the putter. Accordingly, after the two golf balls are struck by the putter, the golfer's eyes continuously move along the two golf balls, which is regarded as a significantly bad habit in golf. Meanwhile, in the above-described device, there is a limitation in that it is impossible to check whether the front end of the putter striking surface and the rear end thereof uniformly strike the two putter striking parts at the same time without movement of the golfer's eyes.

In addition, in the above-described device, it is difficult to determine finely uneven putting strokes on the front end and the rear end. That is, there is a problem in that it is difficult to distinguish between: finely uneven putting strokes which are slightly different because this device uses a method of grasping unevenness of a putting stroke by consistently watching traveling directions of golf balls with the golfer's eyes.

DISCLOSURE

Technical Problem

Therefore, the present invention has been made in view of the above problems, and it is an object of the present invention to provide a putting practice device configured to enable training of keeping a putter face square without checking movement of a golf ball.

It is another object of the present invention to provide a putting practice device configured to enable training of controlling putting strength as well as keeping the putter face square.

It is a further object of the present invention to provide a putting practice device configured to enable training of practicing linear motion of a putter during execution of a putting stroke while an actual golf ball is struck.

Technical Solution

In accordance with the present invention, the above and other objects can be accomplished by the provision of a putting practice device for training of keeping a putter face square and controlling putting strength, the putting practice device including a base plate having an advance groove formed therein and configured to enable a golf ball to be mounted therein and to advance forwards therealong, and a distance display part formed therein and configured to measure a distance of a backstroke along a central line of the advance groove, a pair of striking parts mounted on the base plate in a state in which the advance groove is interposed therebetween, wherein the pair of striking parts has a space therebetween narrower than a width of a head of a putter so that the head of the putter strikes the pair of striking parts during putting and has striking surfaces thereof struck by the head of the putter and formed on the same line, an impact sensor configured to detect impact of the head of the putter striking each of the pair of striking parts, and a display part configured to display a result detected by the impact sensor.

The pair of striking parts may be configured to adjust the space therebetween on the base plate so that the head of the putter passes therethrough.

One of the pair of striking parts may be a fixing part fixed to the base plate and the other one may be a moving part configured to be moved on the base plate so as to adjust a distance to the fixing part, and the base plate may have a guide groove formed therein in a direction perpendicular to the advance groove, wherein the guide groove may allow the moving part to be moved therealong.

The base plate may have a pair of guide grooves formed therein and configured to be symmetrical in a direction perpendicular to the advance groove, wherein each of the striking parts may be moved along a corresponding one of the pair of guide grooves.

The pair of striking parts may be connected to each other by a space adjustment means so that, when any one of the striking parts is moved in one direction along the guide groove, the other one may be moved in the other direction to simultaneously adjust the space between the striking parts.

The base plate may include a movement prevention pad mounted around the advance groove and configured to prevent any movement of the golf ball placed in the advance groove.

A plurality of the impact sensors may be installed at a regular distance along the striking surfaces to detect an area of the head of the putter struck on the striking surfaces.

Advantageous Effects

According to a putting practice device for training of keeping a putter face square and controlling putting strength, it is possible to check whether the putter face is squared visually or audibly without checking movement of a golf ball, thereby having an effect of improving directionality of putting.

Further, according to the present invention, it is possible not only to keep the putter face square, but also to perform training of controlling putting strength, thereby having an effect of improving accuracy of a movement distance of a golf ball as well as the directionality of putting.

Additionally, according to the present invention, it is possible to perform training of practicing linear motion of a putter during execution of a putting stroke while an actual golf ball is struck, thereby having an effect of performing training that can be applied to an actual golf game by expanding training of directionality of putting and the training of a movement distance of a golf ball.

DESCRIPTION OF DRAWINGS

The above and other objects, features and other advantages of the present invention will be more clearly understood from the following detailed description taken in conjunction with the accompanying drawings, in which.

BEST MODE

Features and advantages of the present invention will become more fully apparent by the embodiments with reference to the accompany drawings.

First, a first embodiment of a putting practice device according to the present invention will be described.

Figure 1:
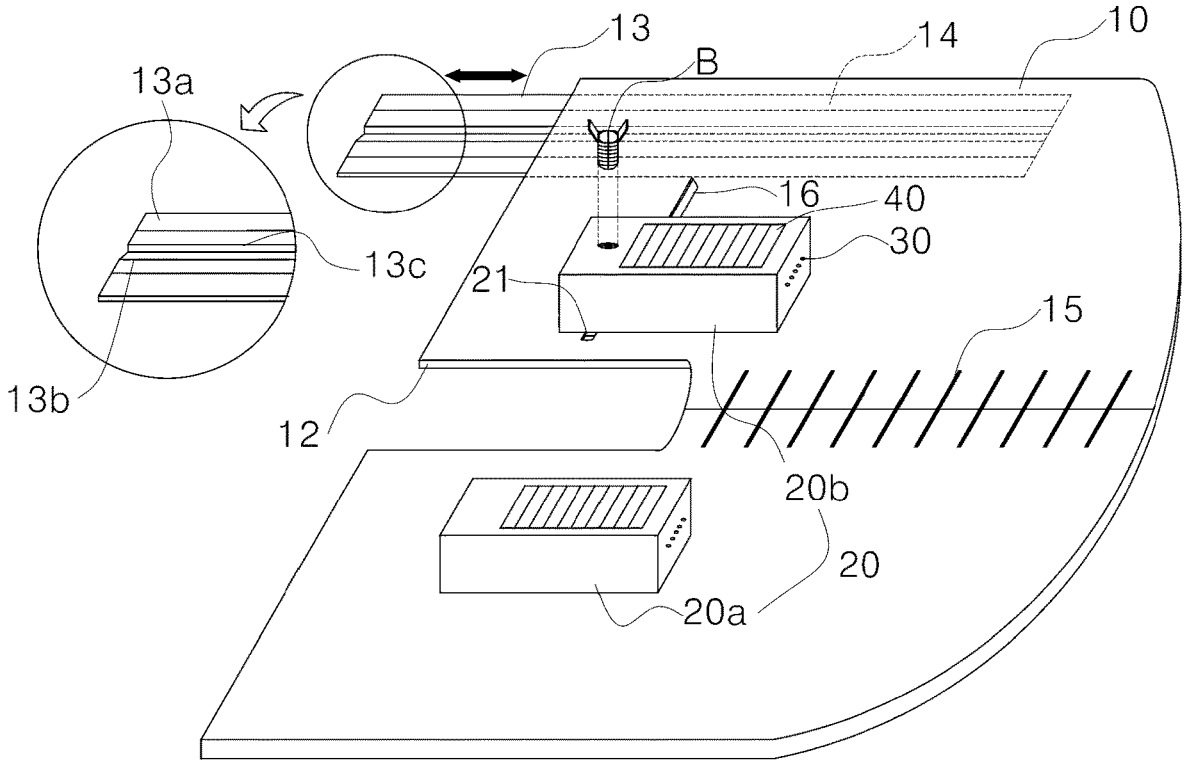
FIG. 1 is a perspective view showing a putting practice device according to a first embodiment of the present invention.
Figure 2:
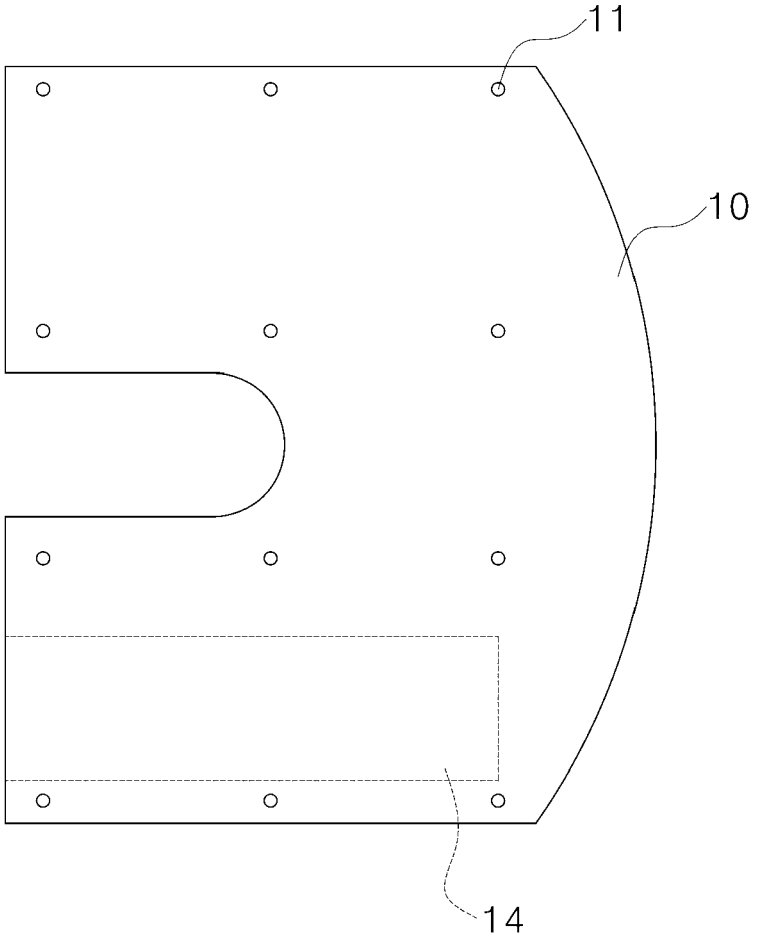
FIG. 2 is a bottom view showing a bottom portion of the putting practice device according to the first embodiment.
Figure 3:
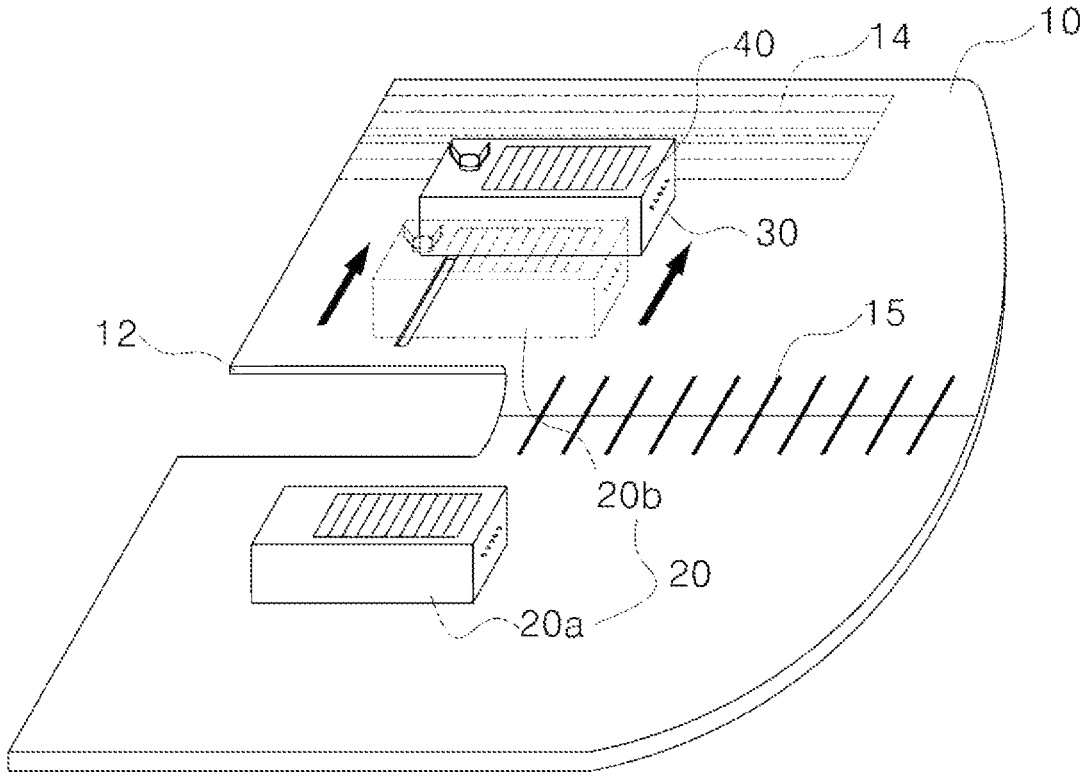
FIG. 3 is a perspective view showing a state in which a moving part of a striking part according to the first embodiment is moved along a guide groove.

FIG. 1 is a perspective view showing the putting practice device according to the first embodiment of the present invention, FIG. 2 is a bottom view showing a bottom portion of the putting practice device according to the first embodiment, and FIG. 3 is a perspective view showing a state in which a moving part of a striking part according to the first embodiment is moved along a guide groove.

As shown in the drawings, the putting practice device for training of keeping a putter face square and controlling putting strength according to the present invention broadly includes a base plate 10, a striking part 20, an impact sensor 30, and a display part 40.

The base plate 10 is formed in the shape of a flat plate, and is provided with an anti-slip member 11 such as a rubber packing to prevent slipping, the anti-slip member 11 being provided on the lower edge portion of the base plate 10. In addition, an advance groove 12 is formed on one side of a central portion of the base plate 10, the advance groove 12 enabling a golf ball to be mounted therein and to advance forwards therealong.

Further, a driving guide part 13 provided to check straightness of a golf ball is mounted in the advance groove 12. The driving guide part 13 includes a driving support plate 13*a* inserted into a bottom surface of the base plate 10, a driving protrusion 13*b* formed to protrude from the driving support plate 13*a* so that opposite sides of the driving support plate 13*a* are fitted into the advance groove 12, and a driving groove 13*c* formed to extend in the longitudinal direction of the driving protrusion so as to confirm movement line of the golf ball on the driving protrusion.

This driving guide part 13 is inserted into a storage groove 14 provided at one end of the base plate 10 when not in use.

Furthermore, a distance display part 15 capable of measuring a distance of a backstroke along a central line of the advance groove 12 is displayed on the upper portion of the base plate 10.

In addition, a guide groove 16 may be formed in the base plate 10 in a direction perpendicular to the advance groove 12. The guide groove 16 is provided to guide the movement of the striking part 20 to be described later, and is formed to be spaced apart from the advance groove 12 only on one side of the advance groove 12 in the first embodiment.

A pair of the striking parts 20 is mounted on the base plate 10 in a state in which the advance groove 12 is interposed between the pair of striking parts 20, and a space between the pair of striking parts 20 is formed to be narrower than a width of a head of a putter so that the head of the putter may strike the pair of striking parts 20 during a putting stroke. Further, striking surfaces of the pair of striking parts 20 struck by the head of the putter are formed on the same line. Therefore, when the putting action is executed, opposite ends of the face of the putter head may strike the pair of striking parts 20 because the space between the pair of striking parts 20 is narrower than the width of the putter head.

The striking part 20 may be configured as described above and may be used for practice of striking a golf ball while keeping the putter face square. Meanwhile, the space between the pair of striking parts 20 may be widened enough to allow the putter to pass through the space therebetween, and a golf ball may be placed in the advance groove 12. Thereafter, a golfer may practice constant linear motion during a putting stroke while actually striking the golf ball between the pair of striking parts 20. To this end, the pair of striking parts 20 may be formed of a fixing part 20*a* fixed to the base plate 10 and a moving part 20*b* configured to be moved on the base plate 10 so as to adjust a distance to the fixing part 20*a*. In this case, the moving part 20*b* is moved along the guide groove 16 described above, and to this end, the moving part 20*b* includes a guide protrusion at the lower end thereof, the guide protrusion being inserted into the guide groove 16.

Since the direction in which the moving part 20*b* is moved and the direction in which the moving part 20*b* is struck by the putter head are perpendicular to each other, the moving part 20*b* may not be fixed, or may be fixed at a specific position through a fixing member as necessary. The fixing member may be made of various materials or components. For example, a wing bolt may be coupled to the moving part 20*b* and fastened to the guide groove 16, thereby making it possible to limit the movement of the moving part 20*b*.

A golfer strikes the pair of striking parts 20 to check whether the face of the putter head is squared. Here, since it is difficult to accurately check whether the face of the putter head is squared only with the golfer's senses such as sight, hearing, or touch, the impact sensor 30 is used in this embodiment. That is, the impact sensor 30 detects the impact of the putter head struck on each of the two striking parts 20, and determines the time point at which the impact is detected. In addition, in order to check strength of a putting stroke, the impact sensor 30) may be additionally provided to check the strength thereof or a separate sensor may be additionally installed.

Further, a plurality of the impact sensors 30 may be installed in the horizontal direction to the striking surfaces of the two striking parts 20, thereby detecting an area of the putter head struck on the striking surfaces thereof. This configuration may be used to determine whether the putting action is executed in a state in which the central line of the base plate 10 and the central line of the putter coincide with each other. That is, even though the putter face is squared, an intended movement trajectory of a golf ball may not be formed when a putting stroke is not executed from the center of the putter. For this reason, it is important to simultaneously check whether the putter face is squared and whether the putting stroke is executed from the center of the putter.

Information detected by the impact sensor 30 may be displayed to a golfer through the display part 40. The display part 40 may be implemented in various forms. For example, the display part 40 may ring through a buzzer, may be displayed in blue striking when the parts 20 are simultaneously struck, or may be displayed in red when the striking parts 20 are struck sequentially. Alternatively, the information may be transmitted to and displayed on a portable device of a golfer, may be displayed on a display window at one end of the base plate 10, or may be displayed on a display window at the upper end of each of the striking parts 20 as in this embodiment.

When the display part 40 is formed in a portable device, the portable device may provide various services such as checking whether the putter face simultaneously strikes the striking parts 20, storage of past data, and data comparison. Such a portable device may be a tablet, a mobile phone, a laptop, or the like. A golfer may perform putting practice by executing an app capable of performing these services on the portable device.

Hereinafter, a description will be given as to operation of the putting practice device for training of keeping the putter face square and controlling the putting strength according to the first embodiment.

The putting practice device for training of keeping the putter face square and controlling the putting strength according to the first embodiment provides a golfer with various putting practices such as a practice of keeping the putter face square, a practice of controlling putting strength at the time of striking a striking part by varying a distance of a backstroke, wherein the distance is indicated on a distance display part, and a practice of putting an actual golf ball while a putter moves in a straight line with a constant linear motion thereof.

Figure 4:
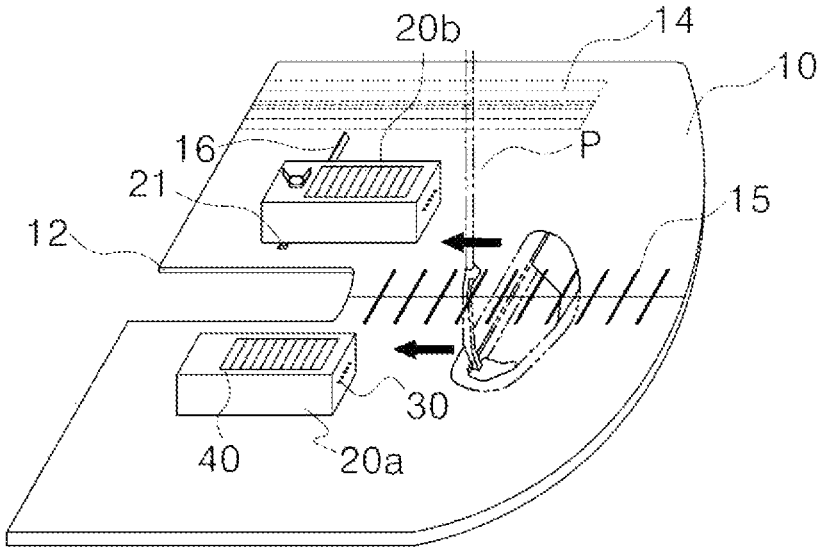
FIG. 4 is a perspective view showing a training process of keeping a putter face square with the putting practice device according to the first embodiment.
Figure 4:
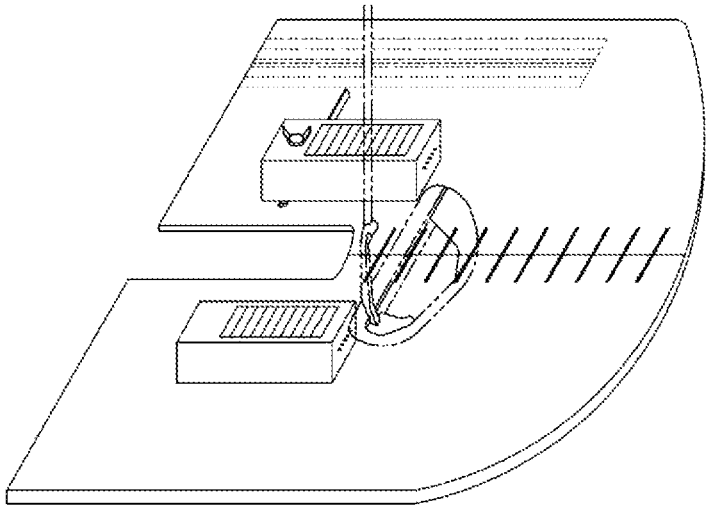

In order to perform training of keeping the putter face square, the space between the pair of striking parts 20 is adjusted to be narrower than the width of the putter head, and then putting is executed. When the putter face strikes the striking surfaces of the pair of striking parts 20, the impact sensor 30 detects this impact and the display part 40 displays a result of whether the putter face is squared or not. For example, as shown in FIG. 4, when the display part 40 of each of the striking parts 20 is displayed with a light-emitting area having the same size, this means that the putter face simultaneously strikes the pair of striking parts 20. In other words, the putter face strikes the pair of striking parts 20 while keeping the same square. Accordingly, a golfer may practice a putting stroke so as to simultaneously strike the striking surfaces of the pair of striking parts 20 with the opposite ends of the putter head (FIG. 4(*b*)) from the backstroke state (FIG. 4(*a*)) in the distance display part 15. In this manner, the golfer may master the movement of keeping the putter face square.

Figure 5:
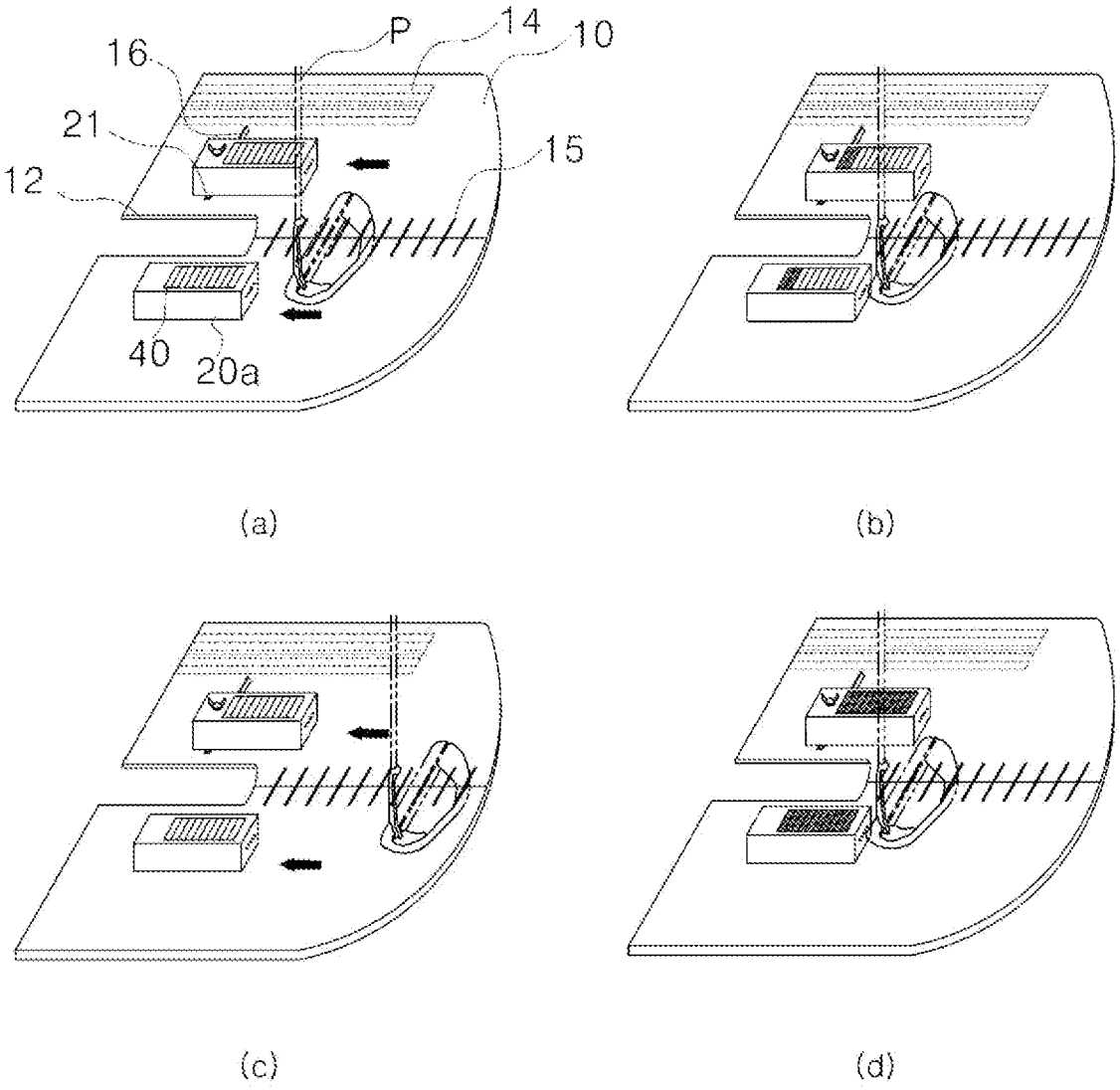
FIG. 5 is a perspective view showing a training process of controlling putting with the putting practice device according to the first embodiment.

It is also possible to practice training of controlling the putting strength along with the training of keeping the putter face square. That is, as described above, when the practice is performed to keep the putter face square, the impact sensor detects a degree of putting strength and displays the result thereof on the display part 40. For example, as shown in FIG. 5, when the putting strength is weak (FIG. 5(*b*)) or strong (FIG. 5(*d*)), each degree of the putting strength is displayed with the size of the light-emitting area on the display part 40, thereby making it possible to check whether putting is executed with intended strength. Accordingly, while striking the pair of striking parts 20 by varying the backstroke distance of the distance display part 15 (FIGS. 4(*a*) and 4(*c*)), the golfer may practice training so as to simultaneously strike the striking surfaces of the pair of striking parts 20 with the opposite ends of the putter head, and also may obtain the ability to control the putting strength.

Figure 6:
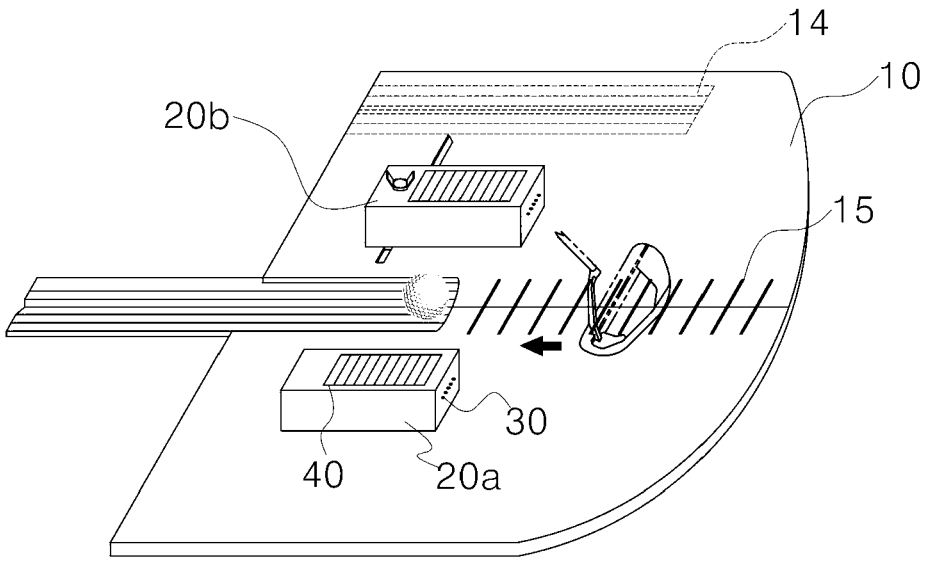
FIG. 6 is a perspective view showing a training process of striking a golf ball by a linear motion of a putter with the putting practice device according to the first embodiment.
Figure 6:
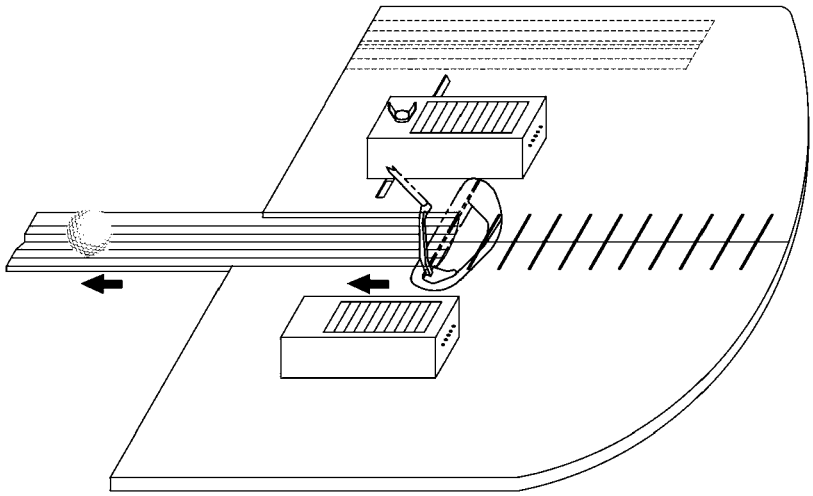

Meanwhile, as shown in FIG. 6, in order to practice training of striking a golf ball, the space between the two striking parts 20 is adjusted to be wider than the width of the putter head, and the driving guide part 13 is taken out from the storage groove 14 and mounted in the advance groove 12, thereby performing putting practice drills. When the putter passes through the space between the two striking parts 20 (FIG. 6(*b*)) in the backstroke state (FIG. 6(*a*)), the putter moves in a straight line after the backstroke is executed and strikes the golf ball. In this manner, the golfer may practice putting while applying the movement of keeping the putter face square to the actual golf ball. In this case, a beginner may practice putting by adjusting the space between the two striking parts 20 to be relatively wide, and a skilled golfer may practice putting by adjusting the space therebetween to be almost the same as the width of the putter head.

In addition, the struck golf ball moves along the driving groove 13*c* of the driving guide part 13. Here, the driving groove 13*c* is not recessed enough to guide the linear movement of the golf ball. Accordingly, when the golf ball does not move in a straight line, the same deviates from the driving groove 13*c*. Conversely, when the golf ball moves in a straight line, the same continuously moves along the driving groove 13*c* formed to extend in the longitudinal direction of the driving protrusion 13*b* and then drives away from the driving guide part 13. Through this configuration, it is possible to practice putting while checking whether the golf ball is accurately struck and is moved in a straight line.

Next, a description will be given as to a second embodiment of the putting practice device for training of keeping the putter face square and controlling the putting strength according to the present invention. In the second embodiment, the same reference numerals will be used to refer to the same components as in the first embodiment.

Figure 7:
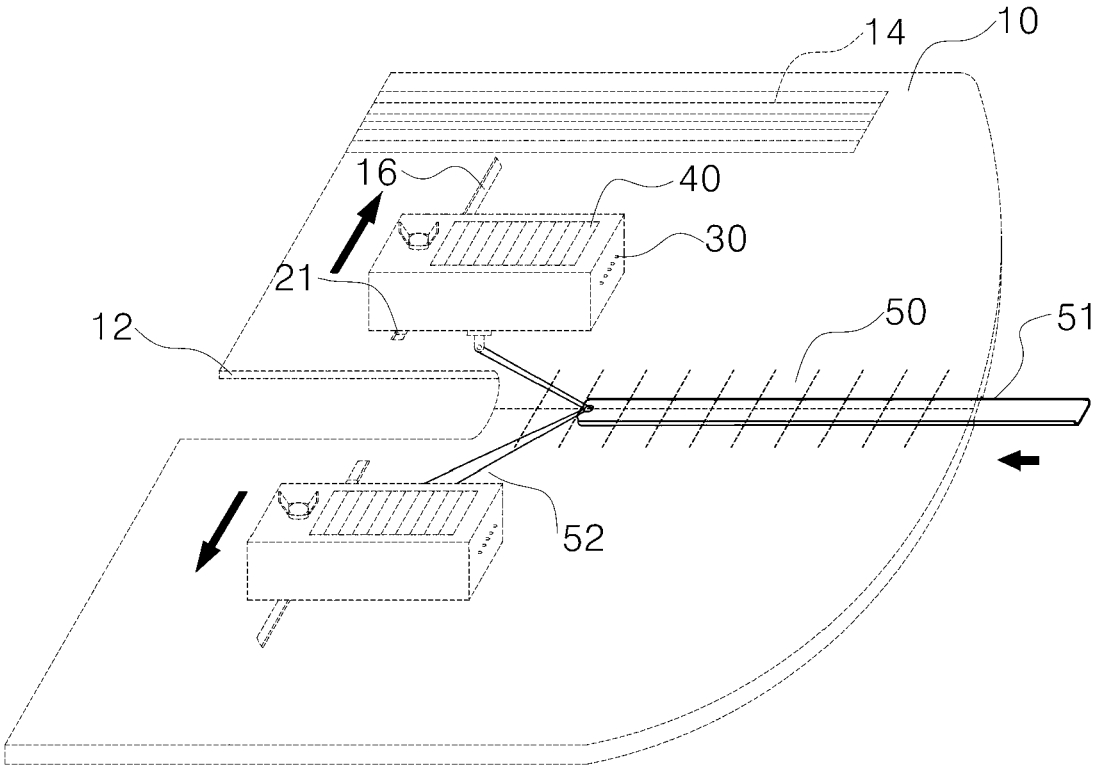
FIG. 7 is a perspective view showing a putting practice device according to a second embodiment.

FIG. 7 is a perspective view showing a putting practice device according to the second embodiment.

As shown in the drawing, in the second embodiment, the base plate 10 has a pair of guide grooves 16 formed therein, the pair of guide grooves 16 being symmetrical in a direction perpendicular to the advance groove 12. Each of the striking parts 20 is moved along a corresponding one of the pair of guide grooves 16. Accordingly, the pair of striking parts 20 may be individually moved so that each of the striking parts 20 is positioned at the same distance from the advance groove 12 and the central line of the distance display part 15.

In this case, as shown in FIG. 7, the pair of striking parts 20 may be connected to each other by a space adjustment means 50 so that, when any one of the striking parts 20 is moved in one direction along the guide groove 16, the other one is moved in the other direction to simultaneously adjust the space between the striking parts 20. The space adjustment means 50 may have various configurations. In this embodiment, the space adjustment means 50 may include an adjustment rod 51 installed inside the base plate 10 and exposed to one side of the base plate 10, and a connection bar 52 having one end thereof hinged to the adjustment rod 51 and the other end thereof hinged to each of the striking parts 20. Therefore, when the adjustment rod 51 is pulled, the striking parts 20 are pulled by the connection bar 52, and as such, each of the striking parts 20 moves along a corresponding one of the guide grooves 16 and the space between the striking parts 20 becomes narrower. Conversely, when the adjustment rod 51 is pushed inwards, the striking parts 20 are pushed by the connection bar 52, and as such, each of the striking parts 20 moves along a corresponding one of the guide grooves 16 and the space therebetween becomes wider.

Since the other configurations are the same as those of the first embodiment, a description thereof will be omitted.

Although preferred embodiments of the present invention have been disclosed for illustrative purposes, the present invention is not limited to the embodiments described above, and those skilled in the art will appreciate that various modifications, additions, and substitutions are possible without departing from the scope and spirit of the invention as disclosed in the accompanying claims.

The invention claimed is:

1. A putting practice device for training of keeping a putter face square and controlling putting strength, the putting practice device comprising:

a base plate having an advance groove formed such that a lateral side of a central part of the base plate is recessed, wherein the advance groove is configured to enable a golf ball to be mounted therein and to advance forwards therealong;

a distance display part formed on the base plate and configured to measure a distance of a backstroke along a central line of the advance groove;

a pair of striking parts mounted on the base plate such that the advance groove is interposed therebetween, wherein the pair of striking parts has a space therebetween narrower than a width of a head of a putter so that the head of the putter strikes the pair of striking parts during putting, and each of the pair of striking parts has a striking surface configured to be struck by the head of the putter and formed on the same line with each other;

an impact sensor installed on the striking surface of each of the pair of striking parts and configured to detect impact of the head of the putter striking each of the pair of striking parts; and a display part configured to display a time point at which the impact by the head of the putter is detected, and a degree of strength applied to the impact sensor by the head of the putter.

2. The putting practice device according to claim 1, wherein the pair of striking parts is configured to adjust the space therebetween on the base plate so that the head of the putter passes therethrough.

3. The putting practice device according to claim 2, wherein:

one of the pair of striking parts is configured to be fixed to the base plate and the other one is configured to be moved on the base plate so as to adjust a distance to the fixing part, and the base plate has a guide groove formed therein in a direction perpendicular to the advance groove, wherein the guide groove allows the other one of the pair of striking parts to be moved therealong.

4. The putting practice device according to claim 2, wherein the base plate has a pair of guide grooves formed therein and configured to be symmetrical in a direction perpendicular to the advance groove, wherein each of the striking parts is moved along a corresponding one of the pair of guide grooves.

5. The putting practice device according to claim 4, wherein the pair of striking parts is connected to each other by a space adjustment rod such that when the space adjustment rod moves, the pair of striking parts are simultaneously moved along the guide groove thereby adjusting the space between the pair of striking parts.

6. The putting practice device according to claim 1, wherein the base plate comprises a movement prevention pad mounted in the advance groove and configured to prevent any movement of the golf ball placed in the advance groove.

7. The putting practice device according to claim 1, wherein a plurality of the impact sensors are installed at a regular distance along the striking surface to detect an area of the head of the putter struck on the striking surfaces.

* * * * *